US005573044A

United States Patent [19]

Mechalas

[11] Patent Number: 5,573,044

[45] Date of Patent: Nov. 12, 1996

[54] VACUUM APPARATUS FOR FILLING BAGS WITH PARTICULATE MATERIAL

[76] Inventor: Emmanuel Mechalas, 123 N. Hazel, Danville, Ill. 61832

[21] Appl. No.: 309,734

[22] Filed: Sep. 21, 1994

[51] Int. Cl.[6] ..... B65B 1/26; B65B 1/18; B65B 3/17

[52] U.S. Cl. ..... 141/83; 141/68; 141/10; 141/12; 141/65; 141/73; 141/93; 141/5; 141/114; 141/315

[58] Field of Search ..... 141/10, 65, 68, 141/114, 286, 59, 5–8, 12, 59, 66, 67, 37, 44, 93, 45, 69, 70, 71, 73, 313–316, 83, 392, 94; 177/190–198

[56] References Cited

U.S. PATENT DOCUMENTS

| | | | |
|---|---|---|---|
| 2,718,630 | 9/1955 | Wait | 141/94 |
| 4,457,125 | 7/1984 | Fishburne | 141/80 |
| 4,524,564 | 6/1985 | Groom et al. | 53/449 |
| 4,648,432 | 3/1987 | Mechalas | 141/68 |
| 4,911,212 | 3/1990 | Burton | 141/94 |
| 5,322,095 | 6/1994 | Bolz | 141/83 |

*Primary Examiner*—Renee S. Luebke
*Assistant Examiner*—Steven O. Douglas
*Attorney, Agent, or Firm*—Neal J. Mossely

[57] ABSTRACT

An automatic bag filling machine employs a reduced pressure or a vacuum within a bag enclosing shroud to draw powdered material at a high velocity into either valved bags or vapor barrier bags to fill the bags with a relatively compacted powder. The shroud has powered movable liner assembly for adjustably enclosing bags of various size. A filling spout and a vapor barrier spout carrier by the shroud each have an expandable boot member to seal the mouth of the bag on the spout to preclude seepage of powdered material from the bag interior during filling. A system is provided for automatic detection of powder escaping from a broken bag. The shroud is supported on a weighing scale which measures the bags and stops flow when filled to a predetermined amount. Alternatively, the weighing scale may support the bag being filled inside the shroud. A filter tank connected to the machine reduces the discharge of powdered material into the surrounding atmosphere, and allows waste material to be reclaimed.

15 Claims, 10 Drawing Sheets

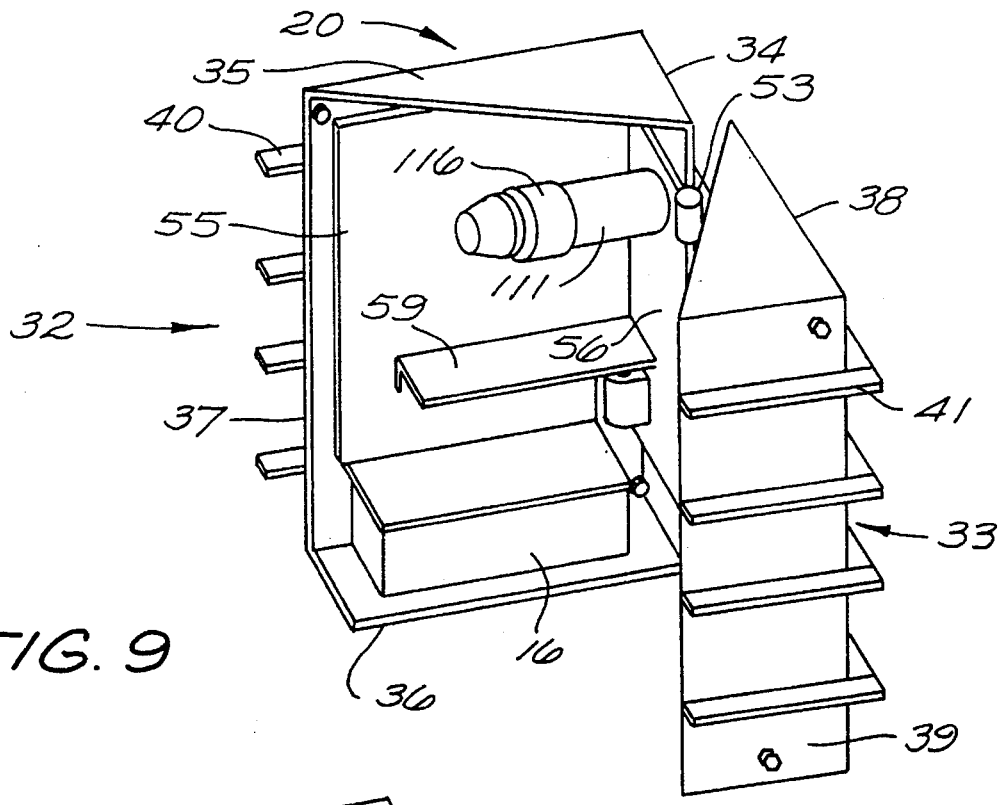
FIG. 9
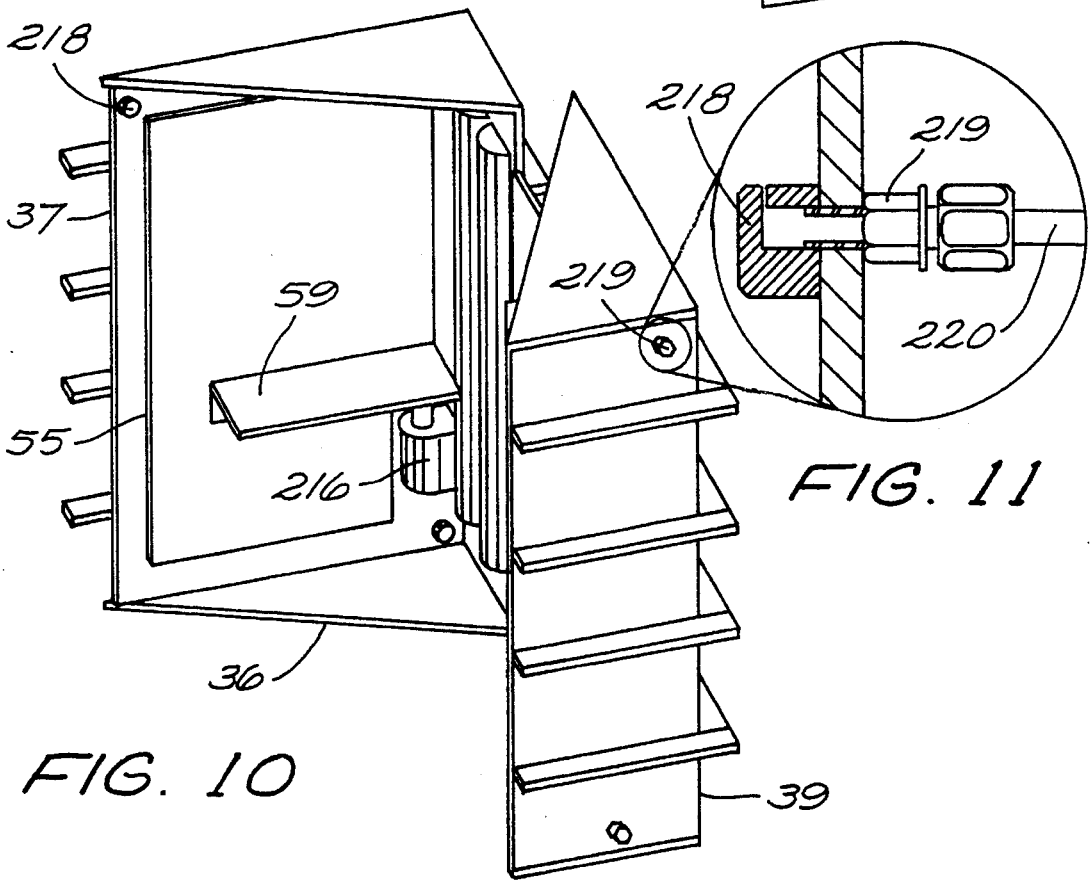
FIG. 11
FIG. 10

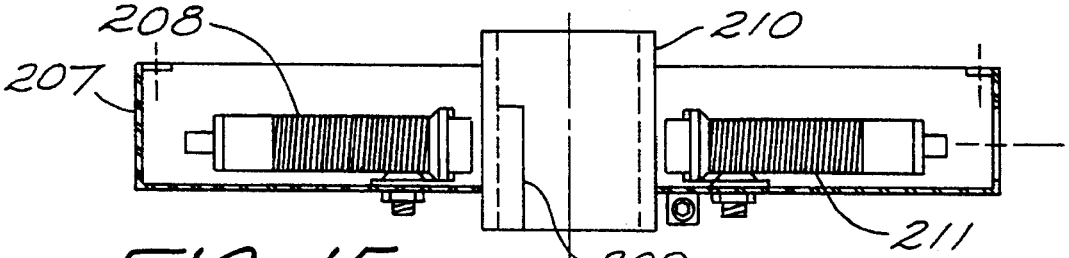
FIG. 15
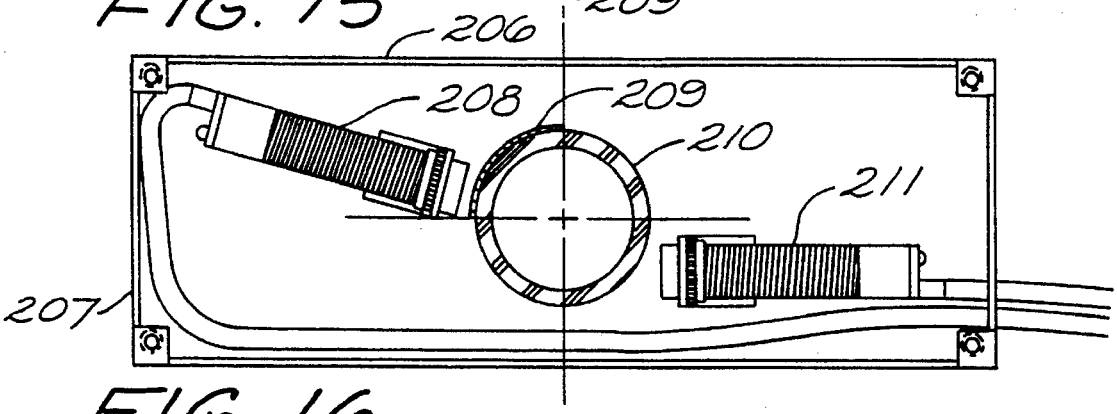
FIG. 16
FIG. 17
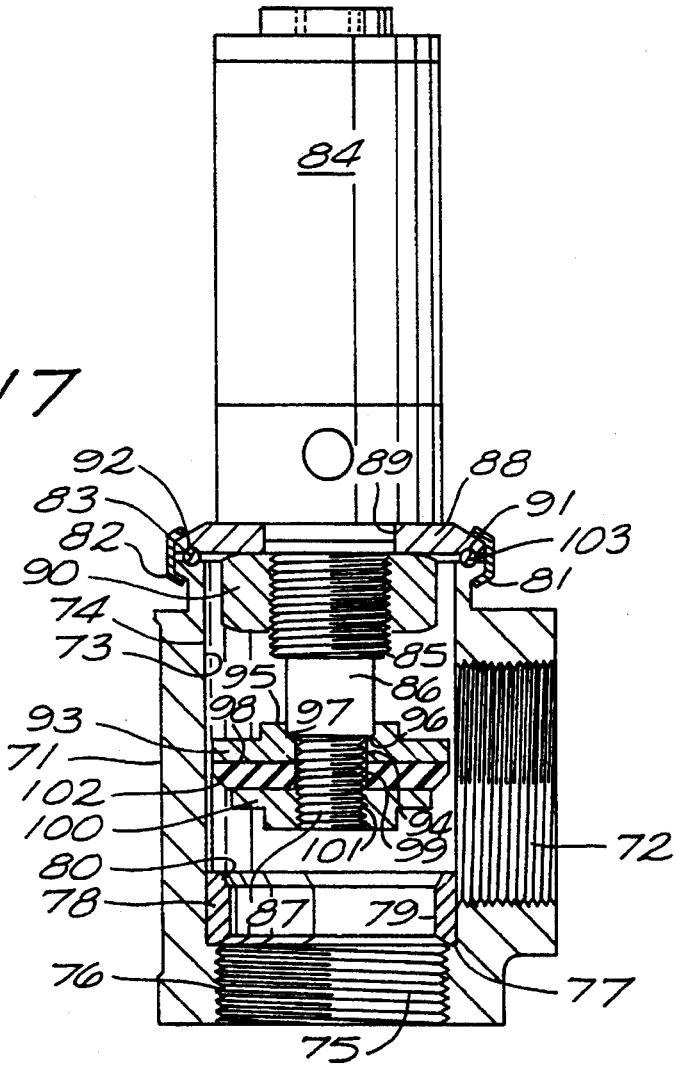

VACUUM APPARATUS FOR FILLING BAGS WITH PARTICULATE MATERIAL

BACKGROUND OF THE INVENTION

1. Field of the Invention

This invention relates to apparatus for dispensing particulate matter, i.e., divided material into receptacles such as valved bags, and more particularly to an automatic bag filling machine which uses vacuum within a bag enclosing shroud to draw finely divided material into the bag in a series of increments to fill the bag more compactly, and includes a number of auxiliary features such as internal scale for weighing, power driven liners, bag break detectors, and high velocity bag filling.

2. Brief Description of the Prior Art

Through the years, a variety of different filling methods and machines for filling receptacles have been developed and have to varying degrees met with satisfactory acceptance in the receptacle filling industry. Although a number of acceptable proposals and machines have been developed for the handling of ordinary particulate materials, it is recognized that special problems are encountered in connection with the handling and dispensing of very finely divided or powdered materials.

With the very finely divided materials as referred to above, there is a tendency for the material to become fluffy by reason of air entrained in the powder. Whereas such entrained air may serve a useful purpose in facilitating freer flow of the material through the dispensing machine to the receptacle being filled, it is a distinct drawback from the standpoint of achieving the desired degree of material compaction within the filled receptacle. Removing this entrained air to compact the material presents a real problem in filling the receptacle with these powdered materials.

In the past, one suggested solution to compacting finely divided material by freeing it of air which becomes entrained between the powder particles has been to subject the receptacle during filling to rapid vibration. Under this filling method, as the particles tend to settle down, material is added to the receptacle until the receptacle contains the desired weight of material for its particular size. Whereas this filling method has been and is presently being used, it has a distinct disadvantage in that it may require a period of several hours of continuous receptacle vibration and repeated material additions to fill a drum with the desired weight of powdered material as for example in the case where silica gel or carbon black is being dispensed. In comparison with this length of time required for vibratory filling, the present invention can achieve the same degree of material compacting in filling the same size receptacle in a matter of minutes.

As a further problem encountered in the handling and dispensing of very finely divided powders, the characteristic of such powders to become dispensed in the atmosphere surrounding the filling machine and thereafter settle on the machine parts and areas adjacent the machine has been recognized as a definite problem in the development of filling machines.

Accordingly, it is of the utmost importance that a filling machine for use in handling such finely divided powders to be constructed to reduce to a minimum the escape of powders either from the machine mechanism itself or from the receptacle as it is being filled.

The construction of the filling machine of the instant invention and its mode of operation have been developed to possess the required characteristics for the handling of finely divided powders. As a further advantage of the filling machine described in detail hereinafter, its automatic operation, commencing from the time of introduction of the bag to be filled into the shroud and continuing through the completion of the bag filling cycle, contributes to reducing the chance for escape of powdered material into the surrounding atmosphere and includes a number of auxiliary features such as internal scale for weighing, power driven liners, bag break detectors, and high velocity bag filling.

The bag filling apparatus of the present invention is a substantial improvement over C. F. Carter U.S. Pat. Nos. 2,756,906, 2,765,816, and 2,799,465 and Emmandel Mechalas U.S. Pat. No. 4,648,432, applicant herein, and manufactured by Modern Machine Shop, Inc. of Danville, Ill. The present invention involves a new apparatus which has a number of specific improved features.

SUMMARY OF THE INVENTION

One object of the present invention is to provide an apparatus and method for filling receptacles with finely divided materials or powders having an improved bag break detector system.

A further object of this invention is to provide an apparatus and method for filling receptacles under vacuum with finely divides materials or powders having a system for high velocity filling.

Still another object of this invention to provide a bag filling machine having a shroud with a powered movable liner to provide an adjustable chamber for enclosing the bag being filled to subject the bag exterior to a reduced pressure.

Yet another object of the instant invention is to provide a filling machine having a shroud supported on a scale mechanism.

A still further object of the invention is to provide a filling machine having a shroud with an internal scale mechanism supporting an weighing a bag being filled.

Other objects of the invention will become apparent from time to time throughout the specification and claims as hereinafter related.

The above noted objects and other objects of the invention are accomplished by an automatic bag-filling machine which employs a reduced pressure or a vacuum within a bag enclosing shroud to draw powdered material at a high velocity into either valved bags or vapor barrier bags to fill the bags with a relatively compacted powder. The shroud has powered movable liner assembly for adjustably enclosing bags of various size. A filling spout and a vapor barrier spout carrier by the shroud each have an expandable boot member to seal the mouth of the bag on the spout to preclude seepage of powdered material from the bag interior during filling. A system is provided for automatic detection of powder escaping from a broken bag. The shroud is supported on a weighing scale which measures the bags and stops flow when filled to a predetermined amount. Alternatively, the weighing scale may support the bag being filled inside the shroud. A filter tank connected to the machine reduces the discharge of powdered material into the surrounding atmosphere, and allows waste material to be reclaimed.

BRIEF DESCRIPTION OF THE DRAWINGS

FIG. 9 is an isometric view of the shroud member showing a filling nozzle and having an internal scale for weighing the bag being filled.

FIG. 10 is an isometric view of the shroud member having an air-dispersing nozzle structure for dispersing the flow of air into the shroud member.

FIG. 11 is a detail sectional view of the air-dispersing nozzle structure opening into the shroud of FIG. 10.

FIGS. 15 and 16 are sectional views of an assembly having a light sensing system for insertion in the vacuum line to the bag-filling shroud for detection of leakage of powder during filling.

FIG. 17 is a central section of a valve member used in the filling machine.

DESCRIPTION OF A PREFERRED EMBODIMENT

Figure 1:
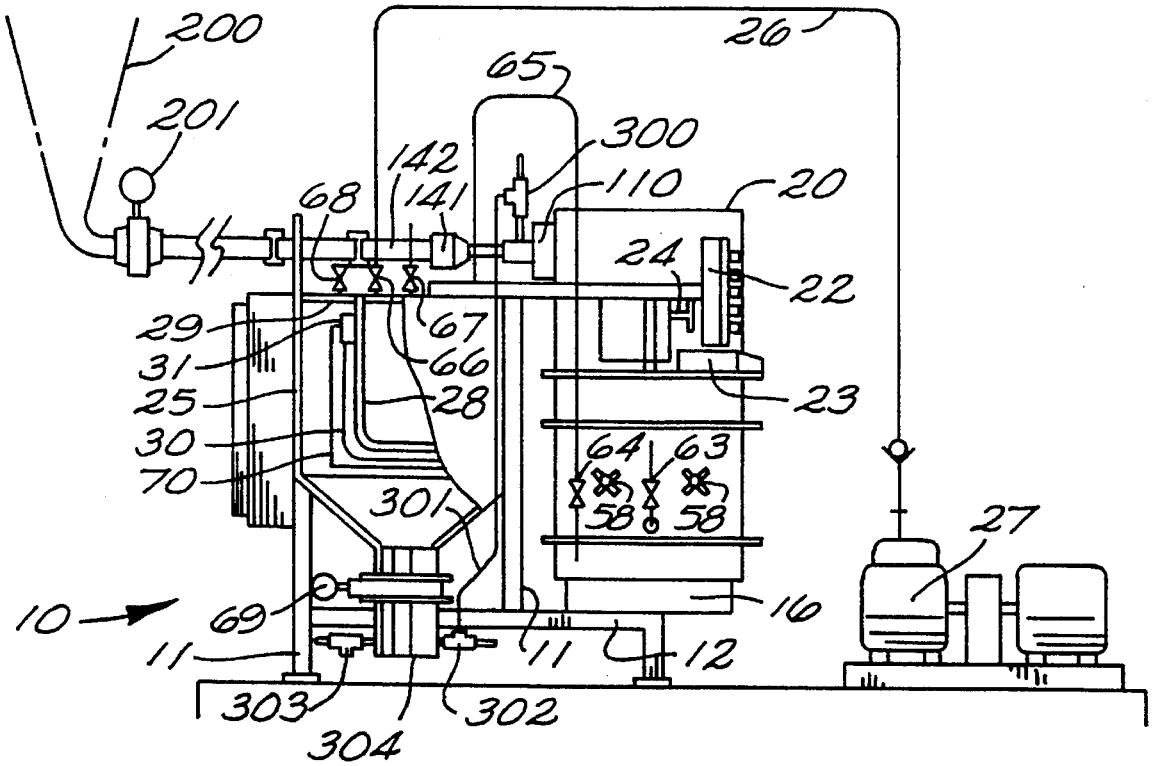
FIG. 1 is a view in front elevation of a bag filling machine incorporating the features of the instant invention.
Figure 2:
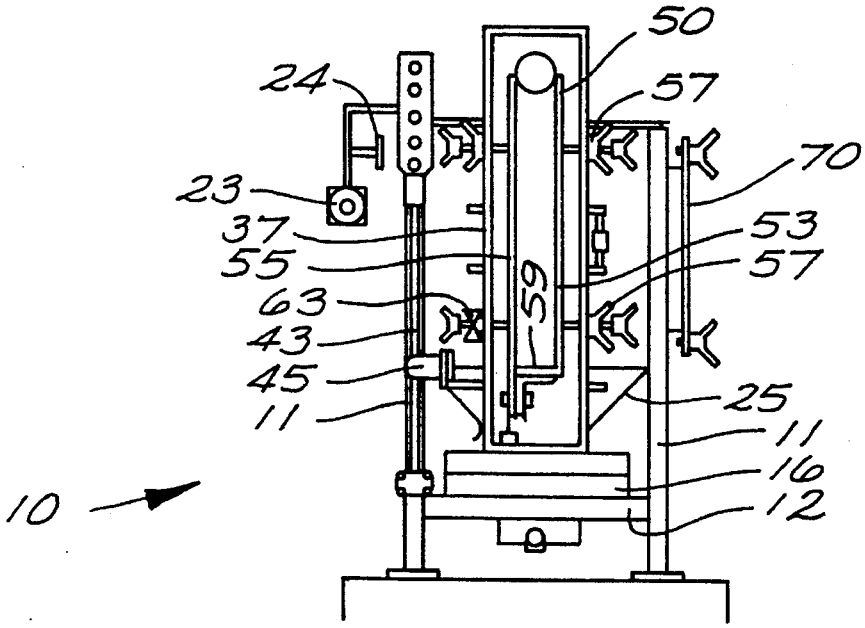
FIG. 2 is a view in side elevation of the machine of FIG. 1, with the shroud member being shown in cross section.
Figure 4:
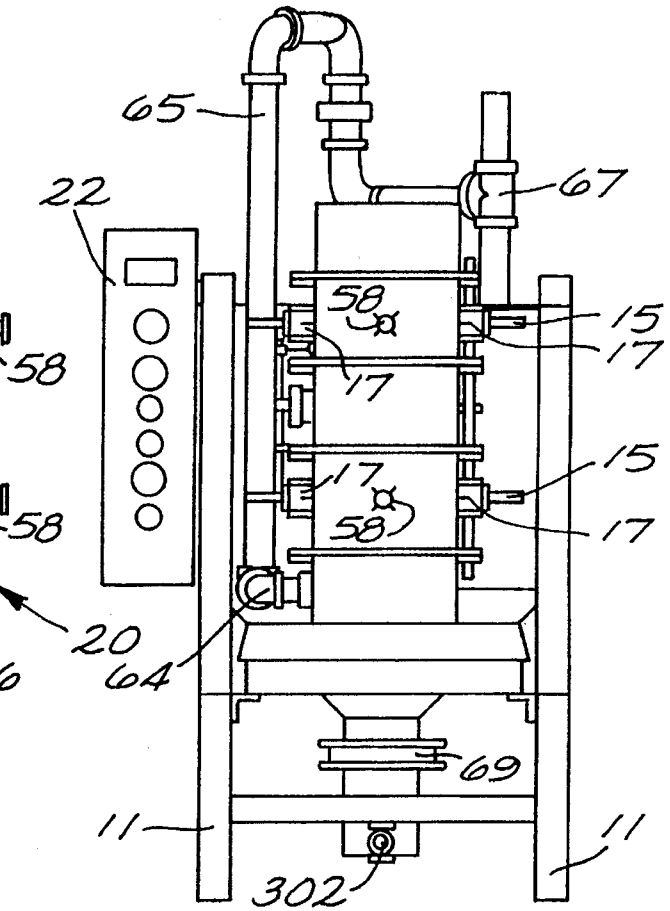
FIG. 4 is an enlarged front elevation of the bag filling machine and system of FIG. 3.
Figure 3:
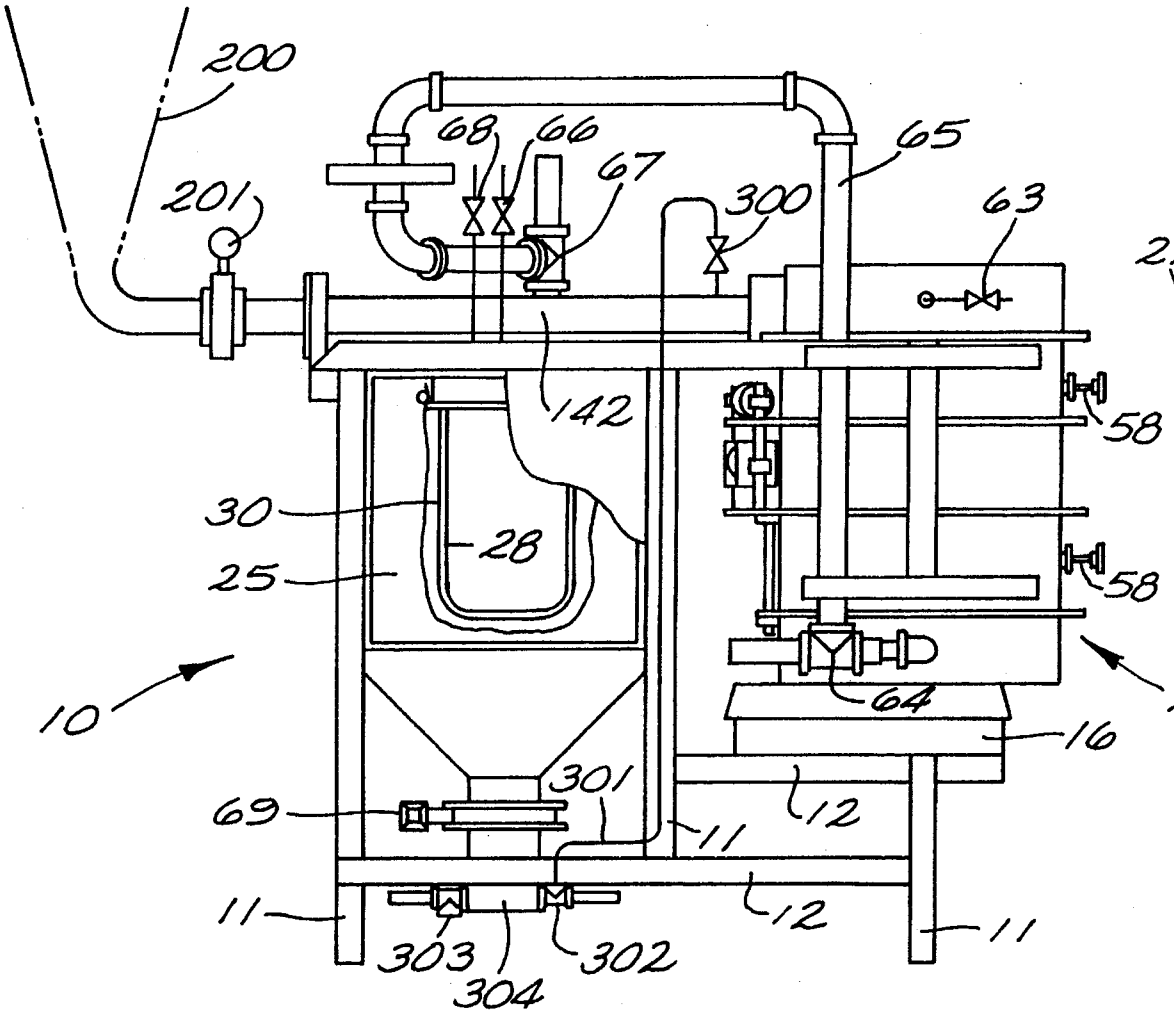
FIG. 3 is an enlarged side elevation, partially in cross section, of the bag filling machine showing a high velocity filling system.

Referring the drawings and specifically to FIGS. 1 and 2, there is shown a bag filling machine which includes a support frame 10 having upright legs 11 interconnected by a plurality of trans-verse frame members 12. An electronic scale mechanism 16, for weighing, is positioned on frame members 12 to support a bag-filling shroud 20. Scale 16 is operable to weigh the contents of a bag filled in the bag-filling machine. A control panel 22 is supported on the frame and includes push button or switches for controlling operation and a read-out scale indicating weight.

A tubular bag-inflating horn 23 mounted on the frame 10 extends forwardly to the side of the shroud 20 to connect to an air supply having a valve 24. The front of the horn 23 is tapered to receive the mouth of a bag for inflating the bag prior to placement into shroud 20 to permit the bag to be filled in the shroud.

A filter tank 25 is supported on the frame 10 and is connected between the vacuum lines 26 and 65 between vacuum pump 27 and shroud 20. Filter tank 25 serves to protect the vacuum pump 27 and to collect and reclaim any dust or fill material which may escape from the processing equipment. Filter tank 25 is a hopper-shaped enclosure having a filter basket 28 of open construction extending downward from the tank top wall 29. A filter bag 30 of fibrous material is inserted over the basket 28 and retained thereon by a clamp 31.

Shroud 20 (FIGS. 6–8) comprises two segments 32 and 33 which are hinged together. One segment 32 has a rear wall 34, top wall 35, bottom wall 36, and side wall 37. The other segment 33 has a front wall 38 and side wall 39. A series of vertically-spaced, flat, rectangular hinge ears 40 and 41 on the outer surfaces of the shroud segments extend outwardly therefrom to pivotally join segments 32 and 33 together. An elastomeric seal strip 42 (FIG. 8) is attached to the inner periphery of front wall 38 and side wall 39 to seal against the edges of side wall 37, top and bottom walls 35 and 36, and rear wall 34 when the two segments are closed. Shaft 44 is mounted vertically on the hinge ears 41 diagonally adjacent the juncture of the front wall 38 and the side wall 39 to form a pivot point for the segment 33. Thus, segment 33 pivots about the longitudinal axis of the shaft 44.

Hinge ears 41, midway of the length of front wall 38, extend rearwardly of shaft 44 and have a vertical rod 47 connected there-between to form an arm 48. A pneumatic actuator 49 is supported on the shroud and has its actuating rod pivotally connected to arm 48 with the cylinder of the actuator pivotally supported on side wall 37. Selective application of pressurized fluid to actuator 49, will open or close shroud 20.

Figure 6:
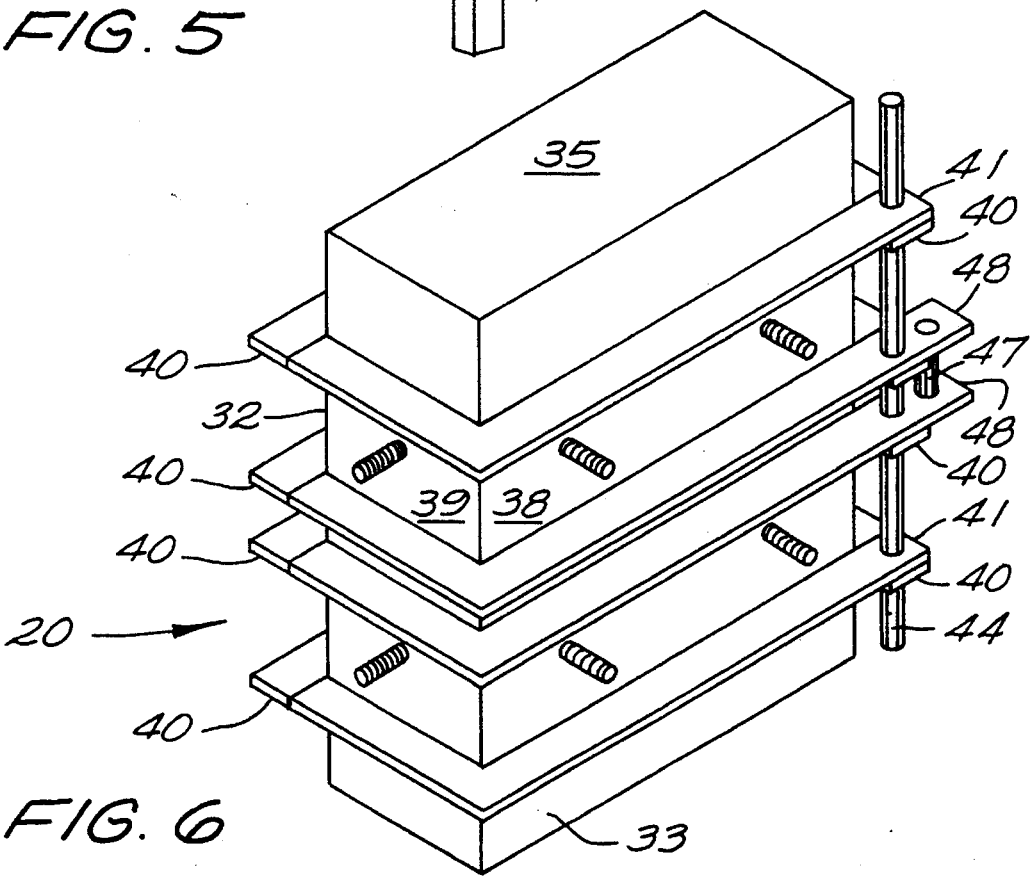
FIG. 6 is an isometric view of the shroud member of FIGS. 1 and 2.
Figure 7:
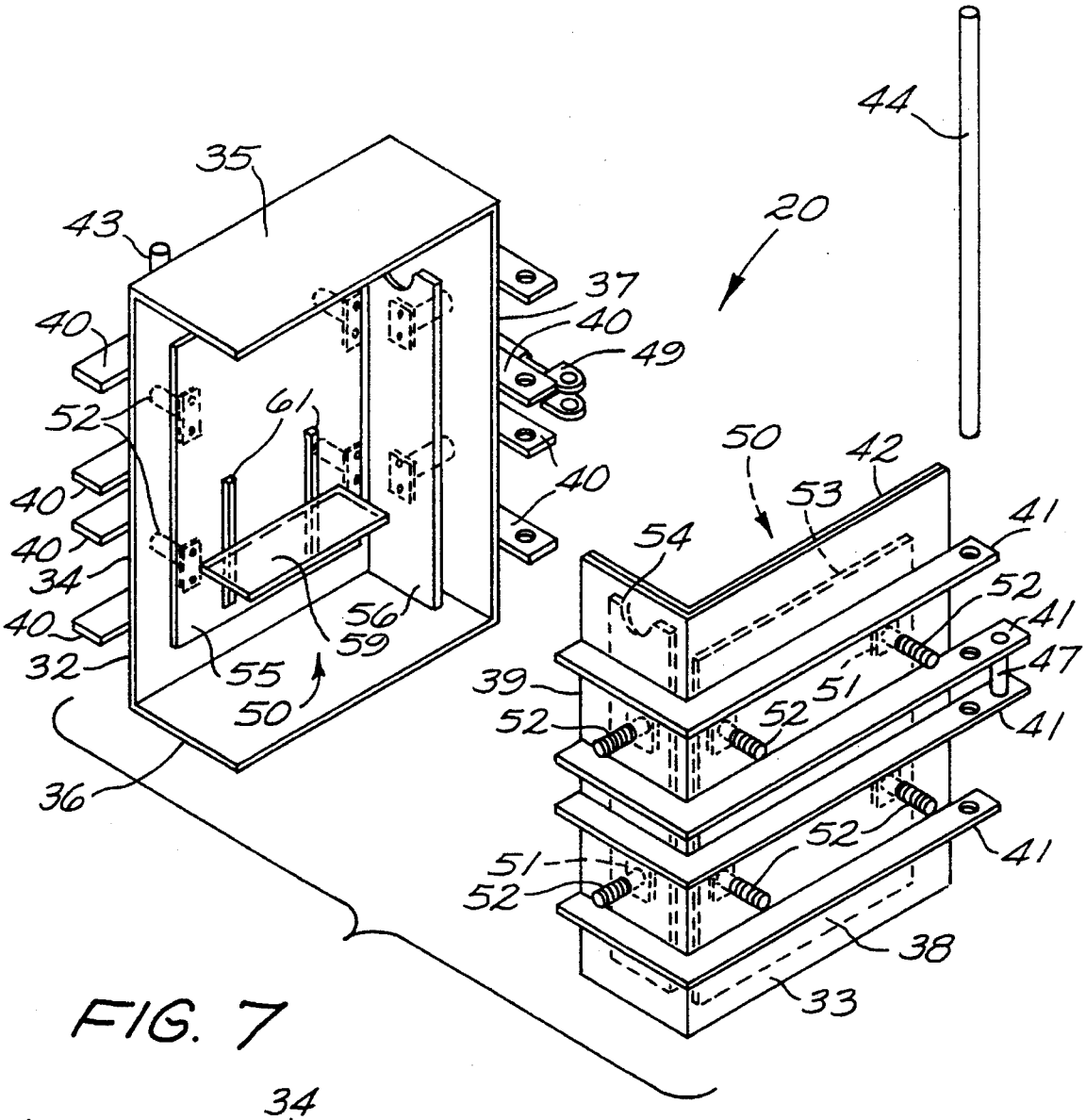
FIG. 7 is an exploded isometric view of the shroud member of FIG. 6.
Figure 8:
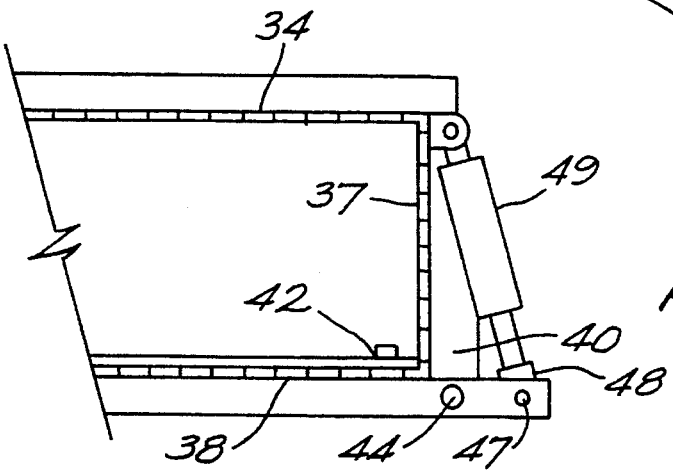
FIG. 8 is a top detail view of a portion of the shroud member of FIG. 6.

As seen in FIGS. 6, 7 and 9, an adjustable liner assembly 50 is positioned within shroud 20 and comprises four opposed parallel rectangular plate members 53, 54, 55 and 56 of suitable material such as aluminum plate. Swivel blocks 51 having a threaded rod 52 with one end rotatably secured therein and the opposed end extending outwardly therefrom are fastened to the outer surface of the plate members.

Front plate 53 is disposed interior of front wall 38 and side plate 54 is disposed interior of side wall 39. Similarly, rear plate 55 and side plate 56 are disposed interior of rear wall 34 and side wall 37 respectively. Each of the extended ends of threaded rods 52 are threaded through locking knobs 57 rotatably attached to the outer surface of the shroud walls, and adjusting knobs 58 are provided on the protruding ends. In this manner, turning adjusting knobs 58 will move the plates relative to one another and turning locking knobs 57 will secure the plates against further movement.

A bottom plate 59 is attached to an inverted L-shaped bracket 60 which is slidably connected for vertical movement within a pair of spaced parallel slots 61 in rear plate 55 and extends perpendicularly outward therefrom. A pair of bolts 62 lock bracket 60 and plate 59 into the desired height above bottom wall 36. Thus, it is a simple matter to appropriately vary the relative positions of the plates of liner assembly 50 to accommodate bags of various sizes and proportions. An alternate embodiment, described below, provides automatic powered adjustment of liner assembly 50.

A relief valve 63 is mounted in the rear wall of shroud 20 to control communication of the shroud interior with atmospheric pressure. A vacuum control valve 64 is mounted in the top wall of shroud 20 and controls communication of the shroud with filter tank 25 through conduit 65.

A vacuum valve 66 and a backwash valve 67 are mounted on top wall 29 of filter tank 25. Vacuum valve 66 establishes communication between vacuum pump 27 and the interior of filter tank 25 in-side filter bag 30. Backwash valve 67 communicates the interior of filter tank 25 with a backwash air supply.

An air inlet valve 68 positioned on the top wall of tank 25 allows air to enter the tank exterior of filter bag 30. A butter-fly valve 69 coupled with a valve actuator are located at the bottom of the tapered portion of the tank 25. An access door 70 on the side of tank 25 allows access to basket 28 for installing and removing filter bags therefrom.

FIG. 17 shows a preferred valve for use in the system where automatic valves are used, etc., valves 64, 66, 67, and 68. Such a valve comprises a tee shaped body member 71 having a threaded side inlet/outlet 72 and a through bore 73 extending downwardly from the top portion 74 to terminate at an internally threaded bottom inlet/outlet 75. The threads 76 of inlet/outlet 75 are of smaller diameter than bore 73 to form a flat annular shoulder 77 therebetween. A cylindrical valve seat member 78 having a bore 78 rests within bore 73 on shoulder 77. Bore 79 at the top of the seat is chamfered to provide an angular sealing surface 80.

Top portion 74 of valve body 71 is machined to form an annular inclined clamping surface 81. The top surface has a circular groove 82 which receives a gasket 83. An air cylinder 84 having a threaded collar portion 85 and a piston rod 86 extending therefrom is attached to valve body 71. The extended end of piston rod 86 is threaded as at 87.

A flat cylindrical mounting disk 88 having a central bore 89 is retained on the air cylinder collar 85 by threading a nut 90 onto the threaded portion of the collar 85. The disk 88 has an annular inclined clamping surface 91 opposed to the clamping surface of the valve body and its bottom surface is provided with a mating groove 92 to receive the upper portion of the gasket 83.

A circular retainer member 93 having a central bore 94 and a counter bore 95 forming a shoulder 96 therebetween is received on the piston rod 86 with the shoulder 96 resting on a mating shoulder 97 on the piston rod. A flat circular elastomeric seal member 98 having a central bore 99 is received on the piston rod 86 below the retainer member 93.

A retaining nut 100 having a central threaded bore 101 is threaded onto the piston 86 to secure the seal 98 between it and the retainer member 93. The outer periphery of the seal 98 is larger in diameter than the retaining nut 100 and is formed to have a circumferential angular sealing surface 102 to mate with the sealing surface 80 of the valve seat 78.

The air cylinder 84 is releasably attached to the valve body 71 by means of a conventional quick release clamp 103 which co-acts with the angular clamping surfaces 81 and 91 to bias the mounting disk 88 and the valve body 71 against the gasket 83.

Figure 18:
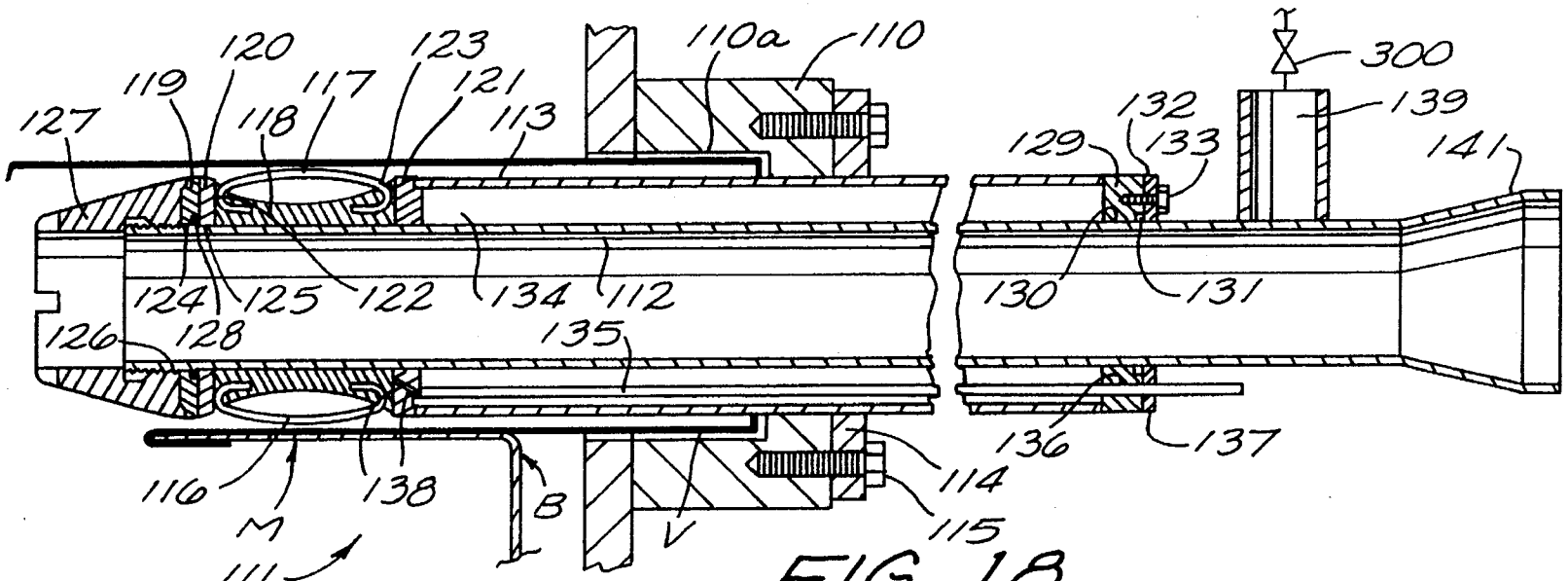
FIG. 18 is a detailed sectional view of the filling spout of the bag filling apparatus.

As shown in FIGS. 9 and 18, shroud 20 has a housing 110 which serves to mount the filling spout 111 that extends inwardly of the shroud interior. The housing 110 has a cylindrical cavity 110*a* receiving the valve portion V of the bag mouth M.

Figure 20:
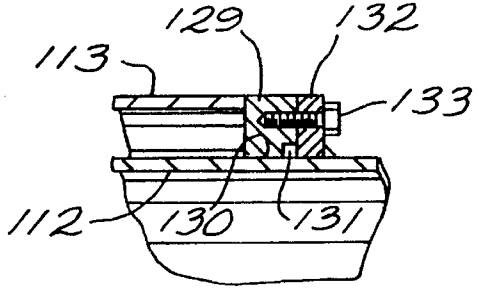
FIG. 20 is an enlarged detailed sectional view of the rear portion of the filling spout of FIG. 18.
Figure 19:
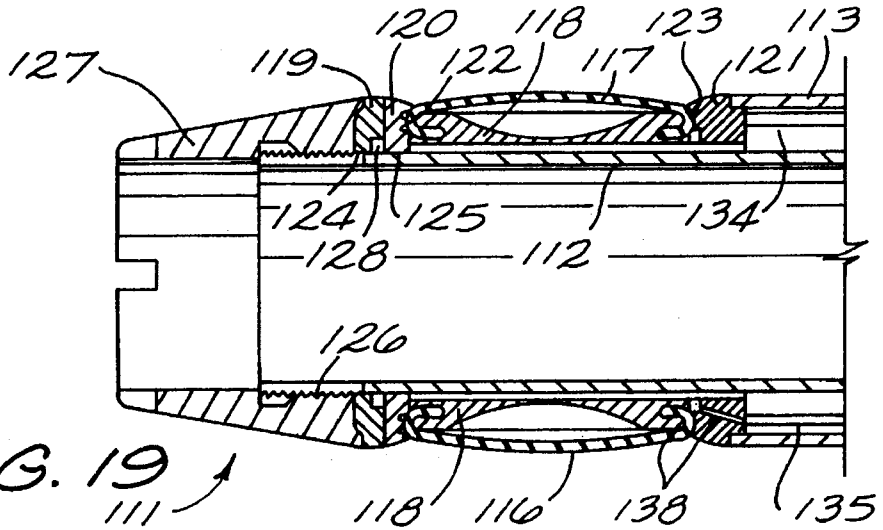
FIG. 19 is an enlarged detailed sectional view of the end portion of the filling spout of FIG. 18.

It will be appreciated that the bag to be filled when positioned for filling will have the filling spout 111 extending through the bag mouth M. Referring now to FIGS. 18, 19, and 20, spout 111 consists of an inner tubular member 112 and a concentric outer tubular member 113 having a flange 114 bolted to housing 110 by bolts 115.

An inflatable seal element or boot 116 is carried on the peri-phery of the inner tubular member 112. Boot 116 comprises a flexible resilient sleeve 117 enclosing a ring sleeve 118 which serves to support the resilient sleeve and hold it in position on the filling spout. A pair of spacer rings 119 and 120 are disposed at the forward end of the boot and a single spacer ring 121 is disposed at the rearward end of boot 116. Spacer rings 120 and 121 have inwardly curved shoulders 122 and 123 which fit the curved forward and rearward ends of the boot ring sleeve 118 to capture and retain the sides of the resilient sleeve 117 therebetween.

The forward pair of spacer rings 119 and 120 have central bores 124 and 125 received on the outer periphery of the inner tubular member 112. The forward end of inner tubular member 112 extends beyond rings 119 and 120 and has exterior threads 126. Resilient sleeve 117, ring sleeve 118, and spacer rings 119, 120, and 121 are biased against each other and retained between the inner tubular member 112 and the outer tubular member 113 by a spout tip 127 threaded onto the extended forward end of the inner tubular member 112. An O-ring seal 128 is provided between the ring 119 and the outer periphery of the inner tubular member 112.

A flat cylindrical end cap 129 (FIG. 20) having a central bore 130 encloses the rearward end of outer tubular member 113. Inner tubular member 112 extends through the bore 130 and an O-ring seal 131 at the rearward end of the bore seals end cap 129 and the outer periphery of inner tubular member 112.

Inner tubular member 112 has a flange 132 welded thereon which is bolted to end cap 129 by bolts 133. With flange 132 bolted to end cap 129 and spout tip 127 tightened, O-rings 128 and 131 are compressed forming a sealed chamber 134 between inner tubular member 112 and outer tubular member 113.

A small conduit or boot tube 135 attached at its forward end to ring 121 extends rearwardly therefrom through bores 136 and 137 in end cap 129 and flange 132 respectively to be connected to a source of pressurized fluid. An air passageway 138 extends through rings 121 and 118 and communicates boot tube 135 with the interior of resilient sleeve 117 for the admission of pressurized fluid thereinto through tube 135. The regulation and control of the admission of pressurized fluid is explained hereinafter.

Inlet 139 is provided on the inner tubular member 112. An adapter 141 on the rearward end of inner tubular member 112 connects the spout to the material fill conduit 142. The inlet 139 is connected to a valve 300.

Figures 21, 22, 23:
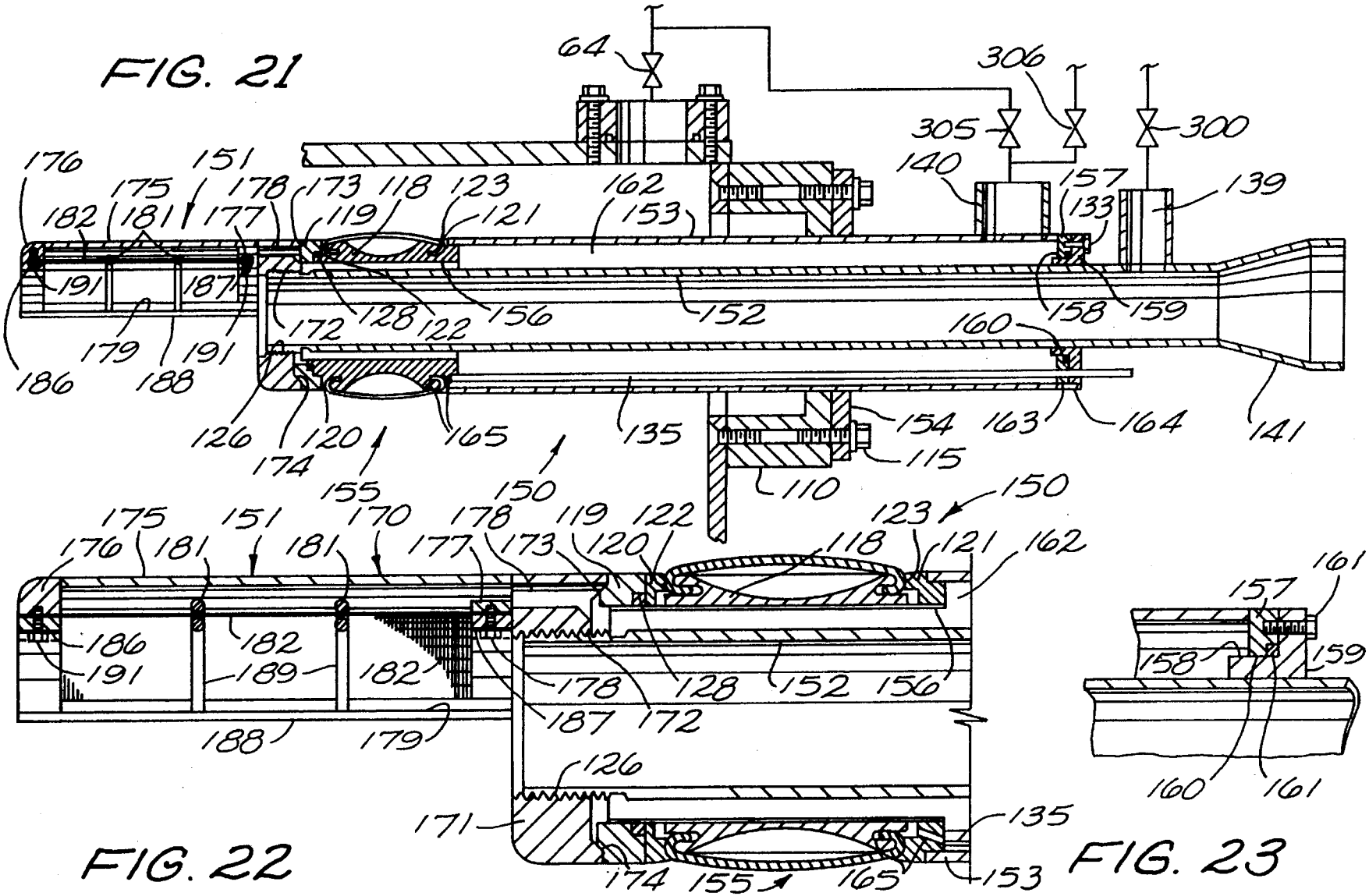
FIG. 21 is a detailed sectional view of the vapor barrier spout and part of the enclosing shroud.
FIG. 22 is an enlarged detailed sectional view of the end portion of the vapor barrier spout of FIG. 21.
FIG. 23 is an enlarged detailed sectional view of the rear portion of the vapor barrier spout of FIG. 21.
Figure 25:
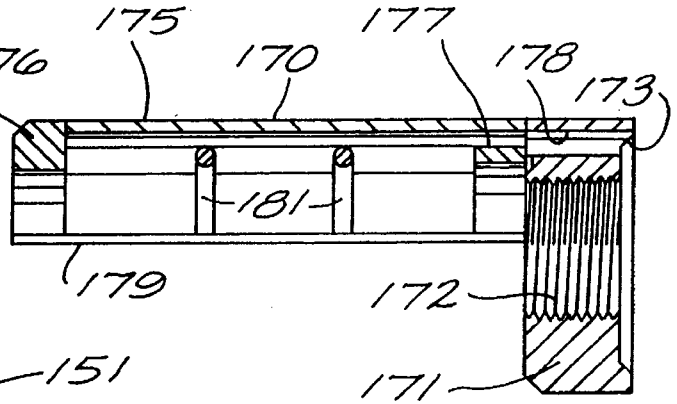
FIG. 25 is a side elevation in cross section of a component of the vapor barrier nozzle.
Figure 26:
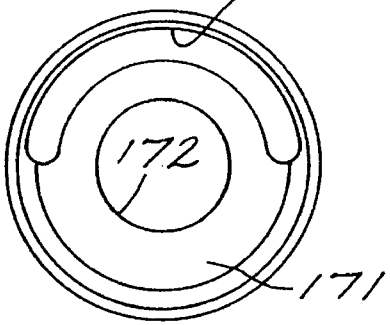
FIG. 26 is an end elevation view of a component of the vapor barrier nozzle.
Figure 24:
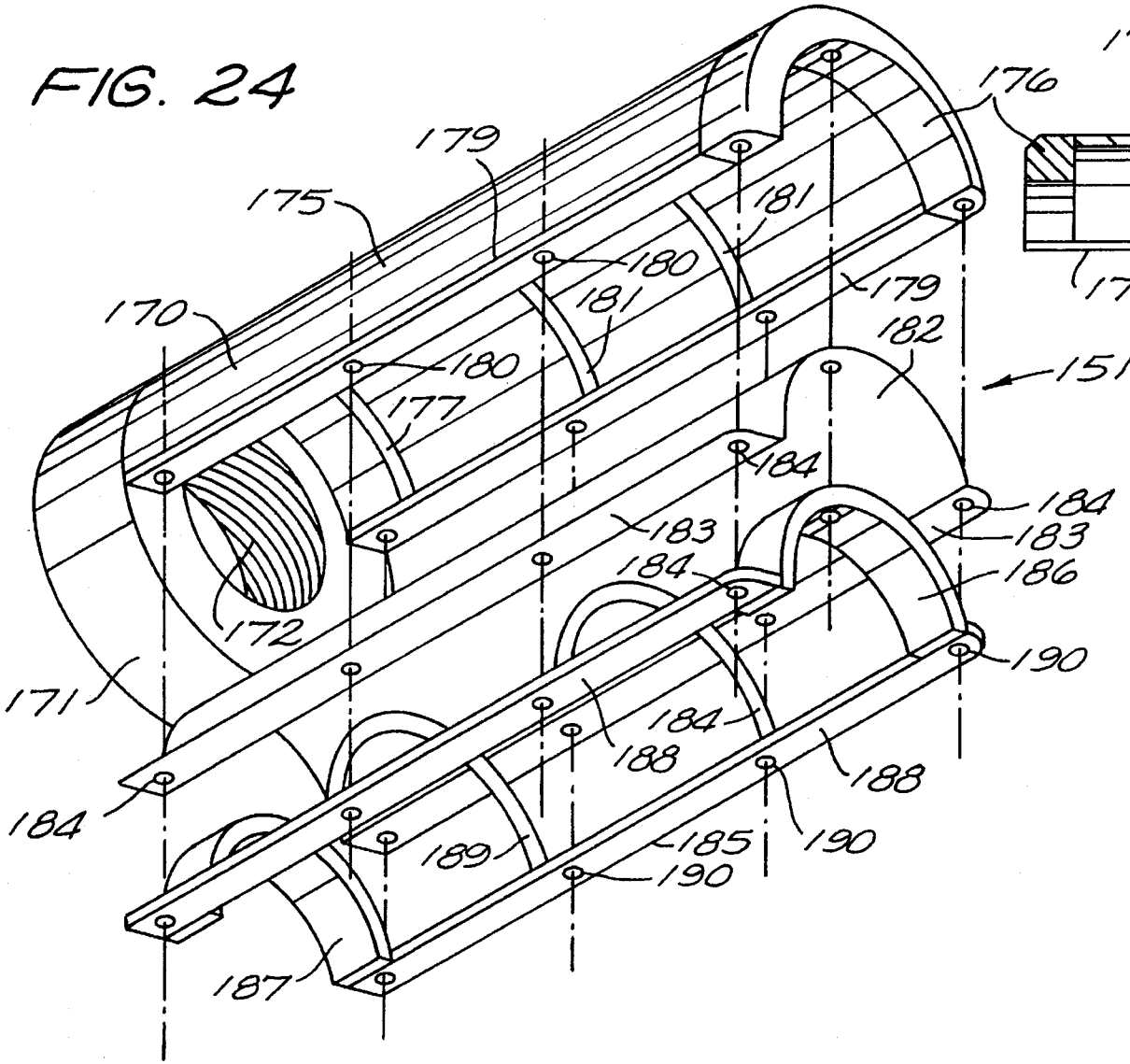
FIG. 24 is an exploded isometric view of the vapor barrier nozzle of the bag filling apparatus.

FIGS. 21,22, and 23 show a vapor barrier spout 150 having a vapor barrier nozzle 151 for filling bags of non-porous material or "vapor barrier" bags having a plastic lining. Vapor barrier spout 150 consists of an inner tubular member 152 and a concentric outer tubular member 153 having a flange 154 bolted to housing 110 by bolts 115. An inflatable seal element or boot 155 is carried on the periphery of the outer tubular member 153. The boot 155 is similar in construction to the boot of FIG. 18 except that the central bores of spacer rings 119, 120 and 121 are received on the outer periphery of a cylindrical inner sleeve 156 instead of on the periphery of the inner tubular member.

The same description and numerals of reference used in FIG. 18 are applied to the same components of FIGS. 21, 22, and 23 to void repetition. The forward end of inner tubular member 152 extends beyond rings 119 and 120 and has threads 126. Resilient sleeve 117, ring sleeve 118, and spacer rings 119, 120, and 121 are biased against each other and retained between inner sleeve 156 and outer tubular member 153 by vapor barrier nozzle 151 (described hereinafter) threaded onto the extended forward end of the inner tubular member 152. An O-ring seal 128 is provided between ring 119 and the outer periphery of the inner sleeve 156.

A flat cylindrical end cap 157 having a central bore 158 encloses the rearward end of outer tubular member 153. Inner tubular member 152 has a flange 159 welded thereon which is bolted to end cap 157 by bolts 133. Flange 159 has a reduced diameter shoulder 160 which extends through bore 158 and an O-ring seal 161 at the rearward end of the bore seals end cap 157 and the outer periphery of shoulder 160. With flange 159 bolted to end cap 157 and vapor barrier nozzle 151 tightened, O-rings 128 and 161 are compressed forming a sealed chamber 162 between inner tubular member 152 and outer tubular member 153.

A small conduit or boot tube 135 attached at its forward end to ring 121 extends rearwardly therefrom through bores 163 and 164 in end cap 157 and flange 159 respectively to be connected to a source of pressurized fluid. An air passageway 165 extends through rings 118 and 151 to communicate boot tube 135 with the interior of resilient sleeve 117 for the admission of pressurized fluid thereto through tube 135. The regulation and control of the admission of pressurized fluid is explained hereinafter.

Inlets 139 and 140 are provided in outer tubular member 153 and inner tubular member 152. An adapter 141 on the rearward end of the inner tubular member for connecting the spout to material fill conduit 142. Inlet 139 is connected to a valve 300, an inlet 140 is connected to a valve 305. Valve 306 is interposed in the line between inlet 140 and valve 305.

Referring now to FIGS. 21 through 26, the vapor barrier nozzle 151 will be explained. Nozzle 151 comprises a hollow semi-cylindrical member 170, one end of which forms a cylindrical ring 171 having a concentric central threaded bore 172 which is received on the threaded end of the inner tubular member 152. An angular inwardly extended clamping surface 173 on the inner end of ring 171 contacts a mating angular surface 174 on spacer ring 119. A semi-cylindrical side wall 175 having semi-cylindrical rings 176 and 177 at each end is attached to the outer end of ring 171 and extends outwardly therefrom. Rings 176 and 177 are of smaller internal diameter than side wall 175 to form a curved surface spaced inwardly of the side wall. An arcuate passageway 178 spaced radially outward of bore 172 extends through ring 171 to communicate the chamber 162 formed between the inner and outer tubular members 152 and 153.

A pair of opposed flat rectangular flanges 179 extend outwardly from and longitudinally along the edges of side wall 175 between rings 176 and 177. A series of longitudinally spaced apart threaded holes 180 are disposed on the flanges 179. A series of semi-circular rods 181 are welded in a longitudinally spaced apart position to the inner surface of the side wall 175.

A wire mesh screen 182 is contoured to conform to the inner diameters of rings 176, 177, and rods 181, and has opposed outwardly projecting longitudinally extending flange portions 183 which mate with flange 179. Holes 184 in the flange portions 183 match the holes 180 of flange 179.

A retaining bracket 185 comprises an open frame structure having semi-circular rings 186 and 187 at each end connected by a pair of parallel flat rectangular flanges 188 extending longitudinally therebetween. A series of semicircular rods 189 are welded to flanges 188 in a longitudinally spaced apart position in concentric alignment with rods 181. Rings 176, 177, and rods 189 are smaller in diameter than the rings and rods of the semi-cylindrical member 170. A series of holes 190 in flanges 188 are aligned with holes 180 in flanges 179.

To assemble vapor barrier nozzle 151, screen 182 is placed into semi-cylindrical member 170 to rest on rings 176, 177 and rods 181, and bracket 185 is placed over the screen. Screws 191 are placed into the appropriate holes and tightened thereby securely clamping screen 182 between the mating rods, rings, and flanges. In this manner, the interior of the bag communicates with atmosphere through nozzle 151, chamber 162, and inlet/outlet 139 and the exterior is subjected to the vacuum inside the shroud while the bag is being filled.

The regulation and control of the admission of pressurized fluid to boot 116 or 155 is accomplished by means of a regulating valve 193 disposed on frame member 194. The boot pressure is normally set at 5 psi to prevent overexpansion and boot damage. Generally, the boot retains the mouth of the bag being filled in prior cooperation with the filling spout. FIG. 18 illustrates in section the relationship of a bag B and its mouth M to the filling spout 111 and boot 116 when the bag is properly positioned for filling.

When the bag to be filled is properly positioned within shroud liner 50 the bag valve mouth will extend into cavity 110*a* so that upon the expansion of boot 116 by the introduction of pressurized fluid thereinto the boot 116 will engage with the bag mouth at a point where such mouth is not backed up or supported.

It will be noted that inlet 139 is provided extending outwardly from outer tubular member 113 to communicate with the atmospheric exterior of the shroud. By providing such an inlet the high vacuum within the shroud, exterior of the bag being filled, will not tend to draw material from the bag outwardly through the bag mouth M past the boot. Instead, the shroud vacuum and the presence of a low pressure within the bag results in any flow of air past the boot passing into the bag, thus precluding the escape of the powdered material in the shroud or atmosphere surrounding the filling machine.

Filling spout 111 through its inner tubular member 112 is connected to a material supply conduit 142. Material supply hopper 200 is coupled to the outer end of conduit 142 with a material fill valve 201 interposed between the bottom of the hopper and conduit 142. Fill valve 201 is at a substantially greater distance from the filling machine than in the apparatus of U.S. Pat. No. 4,648,432 which allows a full vacuum to be drawn on the material fill line 142 so that when valve 201 is opened the material in hopper 200 can reach speeds great enough to impinge one particle upon another, causing a tighter fill or a breaking of particles to suit the fill requirements.

The degree of compacting achieved by utilization of the principles of the herein disclosed invention may be varied in several ways. First, if a high degree of final product density in the receptacle is desired, a greater number of smaller size increments may be combined to complete the filling of the receptacle than would be used of a lower density product is wanted. Secondly, the degree of vacuum used in the filling operation may be selected to secure the desired compacting or density of the product from the filling operation. Thus, where a high vacuum is employed, the filled receptacle will have a higher density of the fill than where a lower vacuum is used in the filling operation. Also, in connection with the filling machines, the final fill product density may be altered by changing the orifice characteristics of the filling spout.

With regard to the vacuum preferably used in the filling operations, a range of from 4 inches to 28 inches of mercury may be employed depending to some extend on the specific material being handled. With most finely divided powered materials a vacuum of from 22 inches to 25 inches has been found to be ideal. However, as a specific example, in filling with carbon black a vacuum of 18 inches has proved desirable, since at higher vacuums undue compacting and caking of the carbon black material may occur.

OPERATION

The overall operation of the apparatus will be understood with reference to FIGS. 1, 2, 18, and 21. The mouth of an empty bag, usually in a flattened condition, is placed onto inflating nozzle 23 and valve 24 is actuated to inflate the bag. A button is pushed to open shroud 20, and inflated bag B is placed into liner assembly 50 with filling spout 111 extending into the mouth M of the bag B, and the liner panels are adjusted to conform to the inflated bag size.

The start buttons are pressed to close shroud door 38. Re-cycling chamber butterfly valve 69 closes, and boot 155 inflates to seal on mouth of the bag to be filled. Vacuum valve 66 opens to the vacuum pump, and backwash valve 67 closes. Shroud vacuum valve 64 opens, drawing a vacuum on the shroud. Valves 300, 302, and 303 open and atmospheric air enters through open valve 303 into recycling chamber 304, picking up any dust in the chamber, conveying dust and air through open valve 302, conduit 301, through open valve 300 into nozzle tube 140 (FIG. 18) and inflating bag B to its fullest against liners 53 and 55. Air passes through the bag walls and the dust remains inside the bag, completing the bag inflating and recycling operation, and valves 300, 302, and 303 close.

FILL-CYCLE

Valve 64 remains open and material fill valve 201 opens allowing material to flow into the bag. As previously noted, fill valve 201 is at a substantially greater distance from the filling machine than in the apparatus of U.S. Pat. No. 4,648,432 which allows a full vacuum to be drawn on the material fill line 142 so that when valve 201 is opened the material in hopper 200 can reach speeds great enough to impinge one particle upon another, causing a tighter fill or a breaking of particles to suit the fill requirements. The distance from valve 201 to the fill chamber provides a reserve of untilled material which can be predensified by closing fill valve 201 and opening valve 64, stopping the material flow and removing the air entrained in the material. When material fill valve 201 is again opened, this predensified material flows into bag B.

SHROUD RELIEF

Valves 64 and 201 close. Shroud relief valve 63 opens, creating a squeeze action on the bag, and blows the bag pores clean, through a backwash action on the bag walls. The fill cycle is on for approximately 3 seconds and the shroud relief cycle is on for approximately ½ second. These cycles alternate until the bag reaches its preset weight as measured by scale 16. When the full weight is reached valves 63 and 64 open, drawing any suspended dust in the shroud into the vacuum tank 25. Dust is collected on filter bag 30 which backwashes two (2) seconds after full weight. Valve 64 closes, boot 155 deflates, door 38 opens, and the operator removes the filled bag.

BACKWASH CYCLE

Valve 66 closes and valve 67 opens to allow atmospheric air to rush into backwash filter bag 30. Dust is blown off the filter bag and falls down through valve 69 which opens at the same time as 67 opens. Dust falls into recycling chamber 304.

OPERATING SEQUENCE FOR VAPOR BARRIER BAGS

The start buttons are pressed to close shroud door 38. Re-cycling chamber butterfly valve 69 closes, and boot 155 inflates to seal on the mouth of the bag being filled. Vacuum valve 66 opens to the vacuum pump, and backwash valve 67 closes. Shroud vacuum valve 64 opens, drawing a vacuum on the shroud, and vacuum valve 305 opens drawing a vacuum inside bag B. Valves 300, 302, and 303 open and atmospheric air enters through open valve 303 into recycling chamber 304, picking up any dust in the chamber, conveying dust and air through open valve 302, conduit 301, through open valve 300 into nozzle inlet tube 139 (FIG. 10) and inflating bag B to its fullest against liners 53 and 55. Air passes through nozzle screen 182 and the dust remains inside the bag, completing the bag inflating and recycling operation, and valves 300, 302, 303 close. Valves 63 and 306 are closed during this cycle.

FILL-CYCLE

Valves 64 and 305 remain open and material fill valve 201 opens allowing material to flow into the bag. Nozzle relief valve 306 is closed during the fill cycle.

SHROUD RELIEF-NOZZLE RELIEF

Valves 64 and 201 close. Shroud relief valve 63 opens, creating a squeeze action on the bag. Nozzle relief valve 306 opens allowing atmospheric air to rush into the nozzle, blowing the dust off of screen 182. The fill cycle is on for approximately 3 seconds and the shroud relief cycle is on for approximately ½ second. These cycles alternate until the bag reaches its preset weight.

When the full weight is reached valves 63 and 64 open, drawing any suspended dust in the shroud into the vacuum tank. Dust is collected on filter bag 30 which backwashes two (2) seconds after full weight. Valve 64 closes, boot 155 deflates, door 38 opens, and the operator removes the filled bag.

BACKWASH CYCLE

Valve 66 closes, valve 67 opens to allow atmospheric air to rush into backwash filter bag 30. Dust is blown off the filter bag and falls down through valve 69 which opens at the same time as 67 opens. Dust falls into recycling chamber 304.

ANOTHER EMBODIMENT—POWERED SHROUD LINERS

In FIGS. 3, 4, 5 and 12, there is shown another embodiment of the bag filling machine which has powered adjustment of the liners in the bag-filling shroud. The overall construction is substantially as previously described and the same reference numerals are used herein for the same parts.

Support frame 10 having upright legs 11 interconnected by a plurality of transverse frame members 12. An electronic scale mechanism 16, for weighing, is positioned on frame members 12 to support a bag-filling shroud 20. Scale 16 is operable to weigh the contents of a bag filled in the bag-filling machine.

Shroud 20 (FIGS. 6–8) comprises two segments 32 and 33 which are hinged together. One segment 32 has a rear wall 34, top wall 35, bottom wall 36, and side wall 37. The other segment 33 has a front wall 38 and side wall 39. A series of vertically-spaced, flat, rectangular hinge ears 40 and 41 on the outer surfaces of the shroud segments extend outwardly therefrom to pivotally join segments 32 and 33 together. An elastomeric seal strip 42 (FIG. 8) is attached to the inner periphery of front wall 38 and side wall 39 to seal against the edges of side wall 37, top and bottom walls 35 and 36, and rear wall 34 when the two segments are closed. Shaft 44 is mounted vertically on the hinge ears 41 diagonally adjacent the juncture of the front wall 38 and the side wall 39 to form a pivot point for the segment 33. Thus, segment 33 pivots about the longitudinal axis of the shaft 44.

Hinge ears 41, midway of the length of front wall 38, extend rearwardly of shaft 44 and have a vertical rod 47 connected there-between to form an arm 48. A pneumatic actuator 49 is supported on the shroud and has its actuating rod pivotally connected to arm 48 with the cylinder of the actuator pivotally supported on side wall 37. Selective application of pressurized fluid to actuator 49, will open or close shroud 20.

Figure 12:
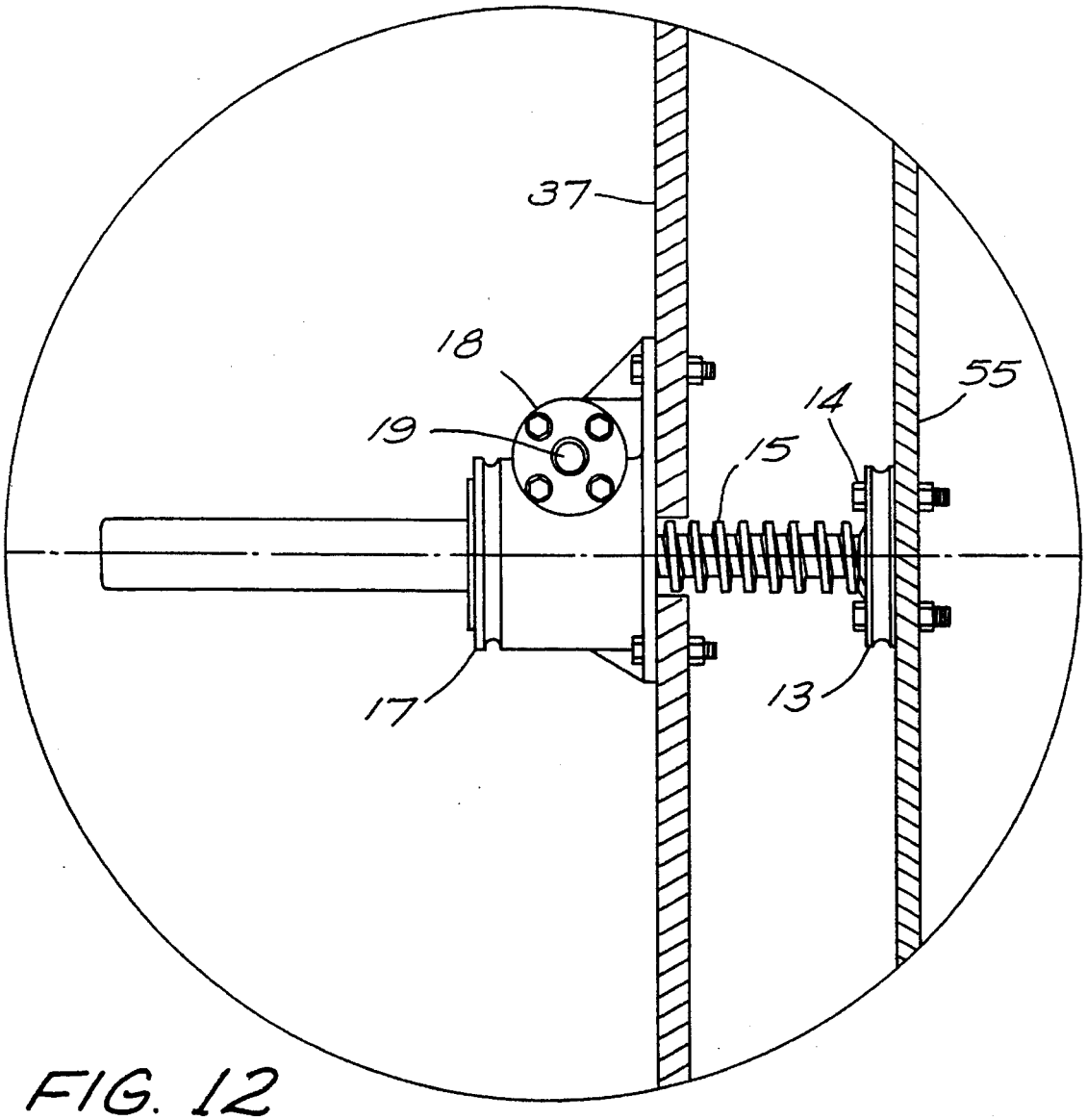
FIG. 12 is a detail section of an alternate embodiment of a shroud having powered adjustable liners.
Figure 13:
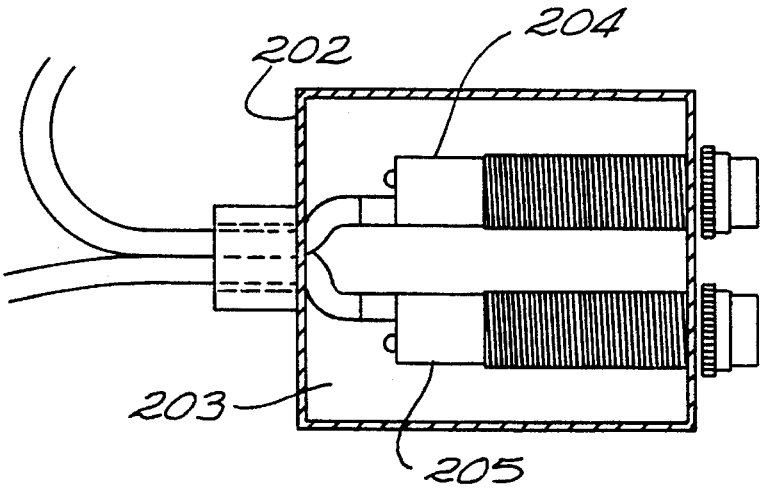
FIGS. 13 and 14 are sectional views of an assembly having a light sensing system for insertion in the bag-filling shroud for detection of leakage of powder during filling.
Figure 14:
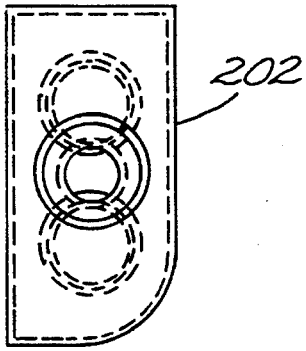

As seen in FIGS. 6, 7 and 9, as modified in FIG. 12, a power-ed adjustable liner assembly 50 is positioned within shroud 20 and comprises opposed parallel rectangular plate members 53 and 55 of suitable material such as aluminum plate. Plates 13 secured on wall 55 (or 53) by bolts 14 support mechanical screws 15 which extend through wall 37 (or 38), see FIG. 12.

Figure 5:
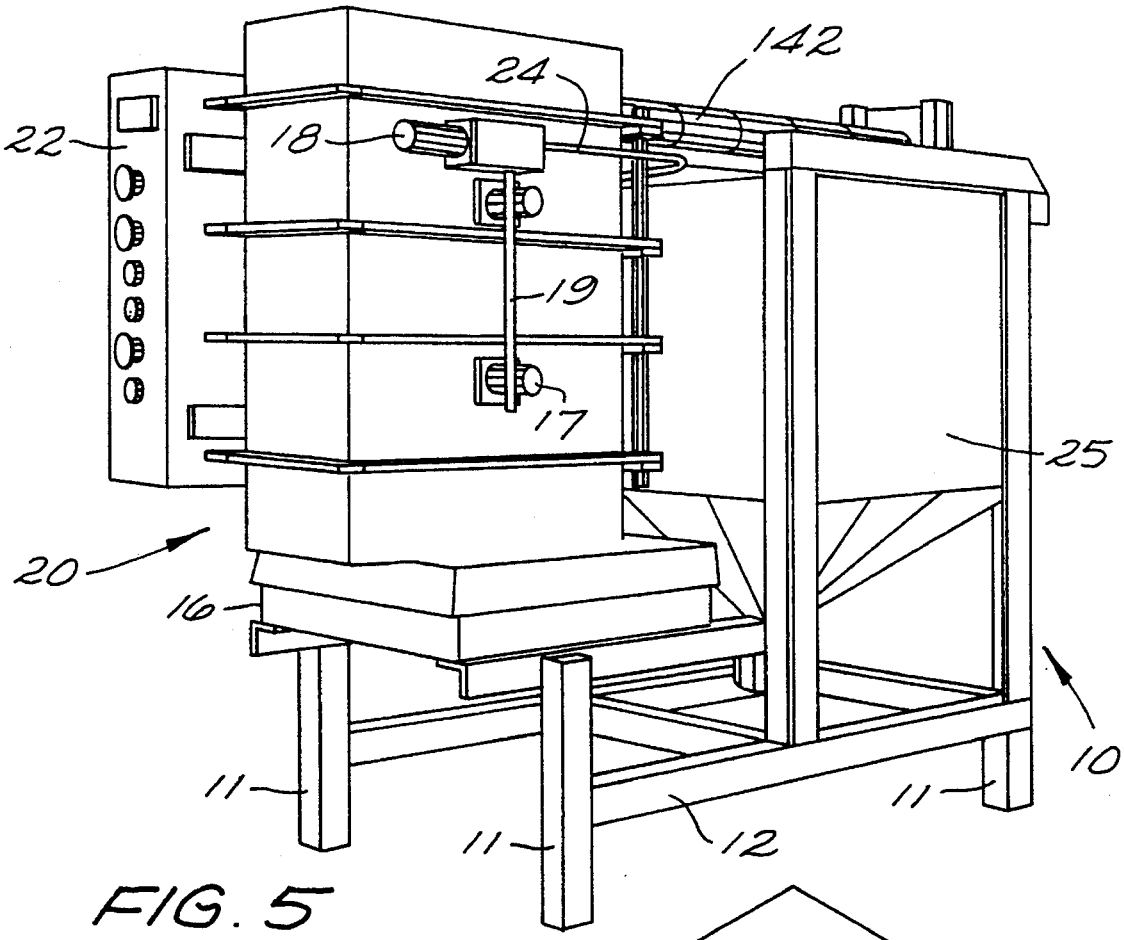
FIG. 5 is an isometric view of the shroud member showing mechanical adjustment of the liners.

Mechanical screws 15 extend through and are driven by gear boxes 17 which are driven by motor 18 driving line shafts 19 (FIGS. 5 and 12). Motor 18 is powered electrically or hydraulically through conduit 21.

Front plate 53 is disposed interior of front wall 38 and side plate 54 is disposed interior of side wall 39. Similarly, rear plate 55 and side plate 56 are disposed interior of rear wall 34 and side wall 37 respectively. Each of the extended ends of mechanical screws 15 are driven by motor 18. In this manner, turning mechanical screws 15 will move the plates 53 and 55 relative to one another and in a stopped position secure the plates against further movement.

A bottom plate 59 is attached to an inverted L-shaped bracket 60 which is slidably connected for vertical movement within a pair of spaced parallel slots 61 in rear plate 55 and extends perpendicularly outward therefrom. A pair of bolts 62 lock bracket 60 and plate 59 into the desired height above bottom wall 36. Thus, it is a simple matter to appropriately vary the relative positions of the plates of liner assembly 50 to accommodate bags of various sizes and proportions.

A relief valve 63 is mounted in the rear wall of shroud 20 to control communication of the shroud interior with atmospheric pressure. A vacuum control valve 64 is mounted in the top wall of shroud 20 and controls communication of the shroud with filter tank 25 through conduit 65.

A vacuum valve 66 and a backwash valve 67 are mounted on top wall 29 of filter tank 25. Vacuum valve 66 establishes communication between vacuum pump 27 and the interior of filter tank 25 in-side filter bag 30. Backwash valve 67 communicates the interior of filter tank 25 with a backwash air supply.

An air inlet valve 68 positioned on the top wall of tank 25 allows air to enter the tank exterior of filter bag 30. A butter-fly valve 69 coupled with a valve actuator are located at the bottom of the tapered portion of the tank 25. An access door 70 on the side of tank 25 allows access to basket 28 for installing and removing filter bags therefrom.

The remaining structure of this embodiment is as described above in connection with the first embodiment. The operation is the same as for that embodiment except for the powered liners in the shroud 20.

ANOTHER EMBODIMENT—INTERNAL SCALE IN SHROUD

In FIG. 9, there is shown an alternate embodiment of the shroud 20 in which the scale 16 is positioned inside the shroud. Shroud 20 (FIG. 9) comprises two segments 32 and 33 which are hinged together. One segment 32 has a rear wall 34, top wall 35, bottom wall 36, and side wall 37. The other segment 33 has a front wall 38 and side wall 39. A series of vertically-spaced, flat, rectangular hinge ears 40 and 41 on the outer surfaces of the shroud segments extend outwardly therefrom to pivotally join segments 32 and 33 together.

Wall 34 has a filling spout 111 that extends inwardly of the shroud interior. An inflatable seal element or boot 116 is carried on the periphery of spout 111. It will be appreciated that the bag to be filled when positioned for filling will have the filling spout 111 extending through the bag mouth and secured by inflation of boot 116.

An electronic scale mechanism 16, for weighing, is positioned on bottom wall 36 to support and weigh the contents of a bag being filled in shroud 20. Scale 16 is operable to weigh the contents of a bag filled in the bag-filling machine.

ANOTHER EMBODIMENT—BAG BREAK DETECTORS

In FIGS. 13–16, there are shown photoelectric devices for detecting breakage or leakage from a bag being filled in the apparatus. These devices are positioned to detect an abnormal amount of dust in the fill chamber or piping.

Assembly 202 (FIGS. 13 and 14) is designed to be mounted inside shroud 20 on wall 37. Assembly 202 comprises a housing 203 enclosing a light-sending device 204 and light sensing device 205, both being conventional photoelectric devices.

Assembly 202 is positioned to direct light from light-sending device 204 to bottom wall 36 to reflect into light sensing device 205. The difference in light transmitted when excess dust is in shroud 20 is detected by light sensing device 205 which signals the controller to start the cleaning cycle by opening vacuum valve 64 and air supply nozzles 218 to establish an air flow carrying dust to the vacuum tank 25.

Assembly 206 (FIGS. 15 and 16) is designed to be mounted in the vacuum piping. Assembly 206 comprises a housing 207 enclosing a light-sending device 208, positioned behind a perforated mask 209, controlling the amount of light passing into clear pipe 210. A light sensing device 211 is positioned to receive light passing through pipe 210. Devices 208 and 211 are both conventional photo-electric devices. As dust passes through pipe 210, receiving device 211 detects the change in light intensity and signals the control unit to stop the fill cycle and turn on the cleaning cycle by holding the door 39 closed, allowing air to entering the shroud through air line 270 and distributing the air into a pattern by passing through the orifices 218 in the nozzle structure mounter on shroud members 37 and 38 by retainer nut 219. While air enters the shroud, vacuum valve 64 opens and carries the dust to the filter tank 25.

While this invention has been described fully and completely with emphasis on several preferred embodiments, it should be understood that, within the scope of the appended claims, this invention may be practiced otherwise than as specifically described.

I claim:

1. A bag filling machine for particulate matter comprising powders and other finely divided material comprising:

a supply hopper supplying particulate matter for bagging, a fill line extending from said hopper for transfer of particulate matter, a first valve actuatable to control the flow particulate matter from the hopper through said fill line, a shroud connected to said fill line to receive particulate matter therefrom, said shroud providing a chamber for receiving a bag during the filling thereof and having hingeably connected segments which open to permit introduction and removal of the bags being filled, a second valve in fluid communication with said shroud actuatable to apply a vacuum to the interior of said shroud, via a conduit having a diameter substantially equal to the diameter of said fill line, surrounding the bag supported therein and said fill line to draw particulate matter from said hopper into the bag positioned on said spout on opening of said first valve, said fill line between said first valve and said shroud being of a predetermined length sufficient to conduct a vacuum to the outlet from said first valve sufficient to cause said particulate matter to reach speeds great enough to impinge one particle upon another, causing a tighter fill or a breaking of particles to suit the fill requirements, weighing means positioned beneath and supporting a bag for weighing a selected amount of particulate matter dispensed into the bag, a feed spout having an outlet end for insertion into the mouth of a bag positioned therein for filling, means for applying a vacuum to the interior of said shroud surrounding the bag supported therein to draw particulate matter from said hopper into the bag positioned on said spout, a dust collector connected between said shroud and vacuum-applying means to collect particulate matter in the air withdrawn from said shroud during said filling operation, said dust collector including back flushing means and container means receiving particulate matter released from said collector in back flushing, and conduit means connected from said container means for recycling particulate matter therefrom into the bar being filled.

2. A bag filling machine according to claim 1 including, means to operate said first valve subsequent to said second valve to apply vacuum adjacent to the outlet from said hopper to draw said particulate matter from said hopper through said fill line at a predetermined high velocity.

3. A bag filling machine for particulate matter comprising powders and other finely divided material comprising;

a supply hopper supplying particulate matter for bagging, a fill line extending from said hopper for transfer of particulate matter, a first valve actuatable to control the flow particulate matter from the hopper through said fill line, a shroud connected to said fill line to receive particulate matter therefrom, said shroud providing a chamber for receiving a bag during the filling thereof and having hingeably connected segments which open to permit introduction and removal of the bags being filled, a liner assembly comprising a plurality of liners adustably mounted within said shroud for receiving bags of varying size and shape, a first plurality of threaded screw members extending through a wall of said shroud for operating one of said liners, a second plurality of threaded screw members extending through a wall of said shroud for operating another one of said liners, and a plurality of motor operated means for each of said liners for adjusting said liners simultaneously, wherein one of said plurality of motor operated means simultaneously operates said first plurality of threaded screw members and another of said plurality of motor operated means simultaneously operates said second plurality of threaded screw members, weighing means positioned beneath and supporting a bag for weighing a selected amount of particulate matter dispensed into the bag, a feed spout having an outlet end for insertion into the mouth of a bag positioned therein for filling, means for applying a vacuum to the interior of said shroud surrounding the bag supported therein to draw particulate matter from said hopper into the bag positioned on said spout, a dust collector connected between said shroud and vacuum-applying means to coiled particulate matter in the air withdrawn from said shroud during said filling operation, said dust collector including back flushing means and container means receiving particulate matter released from said collector in back flushing, and conduit means connected from said container means for recycling particulate matter therefrom into the bag being filled.

4. A bag filling machine according to claim 3 in which, said liners comprise parallel rectangular plate members positioned within said shroud, a first plurality of threaded screw members extending through a wall of said shroud for operating one of said liner plate members, a second plurality of threaded screw members extending through a wall of said shroud for operating another one of said liner plate members, a first gear box arranged to operate said first plurality of screw members and a second gear box arranged to operate said second plurality of screw members to operate said first and second pluralities of screw members simultaneously, and motor means for operating said gear boxes.

5. A bag filling machine according to claim 3 including a bottom liner plate slidably connected for vertical movement in said shroud to a desired height above the bottom wall thereof.

6. A bag filling machine according to claim 3 further having, a fluid driven actuator connected to open and close said shroud segments supported by said weighing means, and means controlling flow of pressurized fluid to said actuator to open and close said segments.

7. A bag filling machine according to claim 3 further comprising, filter means connected between said vacuum-applying means and said shroud, said filter means having a filter bag of fibrous material for capturing particulate matter escaping during the filling operation.

8. A bag filling machine according to claim 3 in which said filter means comprises, a filter tank having a vacuum valve and a backwash valve mounted thereon and a basket frame for clamping filter bags therein, said vacuum valve connecting said vacuum-applying means to said tank inside the filter bag, and said backwash valve connecting the filter tank with a backwash air supply, an air inlet valve on said tank for allowing air to enter said tank exterior of the filter bag, a butterfly valve coupled with a valve actuator at the bottom of said tank, and an access door on the side of said tank for installing and removing filter bags from said basket frame.

9. A bag filling machine for particulate matter comprising powders and other finely divided material comprising;

a supply hopper supplying particulate matter for bagging, a fill line extending from said hopper for transfer of particulate matter, a first valve actuatable to control the flow particulate matter from the hopper through said fill line, a shroud connected to said fill line to receive particulate matter therefrom, said shroud providing a chamber for receiving a bag during the filling thereof and having hingeably connected segments which open to permit introduction and removal of the bags being filled, photoelectric means to detect the presence of powder or other finely divided particles in said machine outside the bag being filled, weighing means positioned beneath and supporting a bag for weighing a selected amount of particulate matter dispensed into the bag, a feed spout having an outlet end for insertion into the mouth of a bag positioned therein for filling, means for applying a vacuum to the interior of said shroud surrounding the bag supported therein to draw particulate matter from said hopper into the bag positioned on said spout, a dust collector connected between said shroud and vacuum-applying means to collect particulate matter in the air withdrawn from said shroud during said filling operation, said dust collector including back flushing means and container means receiving particulate matter released from said collector in back flushing, and conduit means connected from said container means for recycling particulate matter therefrom into the bags being filled.

10. A bag filling machine according to claim 9 in which, said means to detect the presence of particulate matter in said machine outside the bag being filled comprises photoelectric means mounted in the machine to detect presence of particulate matter in the shroud or in the piping.

11. A bag filling machine according to claim 10 in which, said photoelectric means in said shroud comprises a housing enclosing a light-sending device and light sensing device, said housing being positioned to direct light from said light-sending device to the shroud bottom wall to reflect into said light sensing device whereby the presence of particulate matter is detected by diminution of light intensity which initiates the cleaning cycle by opening said second valve to establish an air flow carrying particulate matter to the vacuum tank, and said photoelectric means comprises a clear section of pipe through which particulate matter may be conducted, a housing enclosing a light-sending device, a perforated mask and a light sensing device, said housing being positioned to direct light from said light-sending device through a clear section of pipe to said light sensing device whereby the presence of particulate matter is detected by diminution of light intensity which initiates the cleaning cycle by opening said second valve to establish an air flow carrying particulate matter to the vacuum tank.

12. A bag filling machine according to claim 10 in which, said photoelectric means comprises a clear section of pipe through which particulate matter may be conducted, a housing enclosing a light-sending device, a perforated mask and a light sensing device, said housing being positioned to direct light from said light-sending device through said clear section of pipe to said light sensing device whereby the presence of particulate matter is detected by diminution of light intensity which initiates the cleaning cycle by opening said second valve to establish an air flow carrying particulate matter to the vacuum tank.

13. A bag filling machine according to claim 10 in which, said photoelectric means is mounted in the vacuum means piping comprising a light sending means and a light receiving and detecting means spaced apart to detect the presence of particulate matter by diminution of light intensity.

14. A bag filling machine according to claim 10 in which, said photoelectric means comprises a housing enclosing a light-sending device and light sensing device, said housing being positioned to direct light from said light-sending device to the shroud bottom wall to reflect into said light sensing device whereby the presence of particulate matter is detected by diminution of light intensity which initiates the cleaning cycle by opening said second valve to establish an air flow carrying particulate matter to the vacuum tank.

15. A bag filling machine according to claim 10 in which, said photoelectric means is mounted inside said shroud on a wall thereof comprising a light sending means and a light receiving and detecting means spaced apart to detect the presence of particulate matter by diminution of light intensity.

* * * * *